US008429794B2

(12) United States Patent
Tagtow et al.

(10) Patent No.: US 8,429,794 B2
(45) Date of Patent: Apr. 30, 2013

(54) ADJUSTABLE DOOR HINGE

(75) Inventors: Gary Tagtow, Sioux Falls, SD (US); Tracy Lammers, Sioux Falls, SD (US); Matt Coplan, Harrisburg, SD (US)

(73) Assignee: Amesbury Group, Inc., Amesbury, MA (US)

( * ) Notice: Subject to any disclaimer, the term of this patent is extended or adjusted under 35 U.S.C. 154(b) by 385 days.

(21) Appl. No.: 12/730,468

(22) Filed: Mar. 24, 2010

(65) Prior Publication Data

US 2010/0242227 A1 Sep. 30, 2010

Related U.S. Application Data

(60) Provisional application No. 61/163,234, filed on Mar. 25, 2009.

(51) Int. Cl.
*E05D 7/04* (2006.01)

(52) U.S. Cl.
USPC ..... 16/238; 16/237; 16/235

(58) Field of Classification Search ..... 16/237, 16/238, 235, 236, 239, 240, 242, 243, 245, 16/246, 248, 249
See application file for complete search history.

(56) References Cited

U.S. PATENT DOCUMENTS

| | | | | |
|---|---|---|---|---|
| 5,701,636 | A | 12/1997 | Jahnke | |
| 5,713,105 | A * | 2/1998 | Toomey | 16/245 |
| 5,755,011 | A | 5/1998 | Green et al. | |
| 6,715,181 | B1 | 4/2004 | Fries | |
| 7,334,293 | B2 * | 2/2008 | Erickson et al. | 16/243 |
| 7,350,272 | B2 | 4/2008 | Fries | |
| 7,516,517 | B2 | 4/2009 | Fries | |
| 7,552,511 | B2 * | 6/2009 | Campbell et al. | 16/238 |
| 7,694,389 | B2 * | 4/2010 | Erickson et al. | 16/243 |
| 8,191,205 | B2 * | 6/2012 | Forrest | 16/273 |
| 2008/0022491 | A1 * | 1/2008 | Campbell et al. | 16/236 |
| 2008/0104799 | A1 * | 5/2008 | Hoppe et al. | 16/238 |
| 2008/0209679 | A1 * | 9/2008 | Erickson et al. | 16/245 |
| 2008/0307606 | A1 * | 12/2008 | Karlsson | 16/243 |
| 2009/0077767 | A1 * | 3/2009 | Alchin | 16/237 |

* cited by examiner

*Primary Examiner* — Jeffrey O'Brien
(74) *Attorney, Agent, or Firm* — Goodwin Procter LLP

(57) ABSTRACT

An adjustable door hinge includes a receptor base and a panel leaf adjustably secured to the receptor base and at least partially defining a vertical adjustment opening and a horizontal adjustment opening. An adjustment transfer element is at least partially contained within the vertical adjustment opening and a vertical adjustment element is rotatably connected to the adjustment transfer element. Rotation of the vertical adjustment element adjusts a position of the panel leaf to any position between a first position and a second position. A horizontal adjustment element is rotatably connected to the horizontal adjustment opening. Rotation of the horizontal adjustment element adjusts a position of the panel leaf to any position between a third position and a fourth position. Vertical and horizontal adjustment of the hinge may be performed independently.

16 Claims, 7 Drawing Sheets

ADJUSTABLE DOOR HINGE

CROSS-REFERENCE TO RELATED APPLICATION

This application claims priority to U.S. Provisional Patent Application Ser. No. 61/163,234, entitled "Adjustable Door Hinge," filed on Mar. 25, 2009, the disclosure of which is hereby incorporated by reference herein in its entirety.

FIELD OF THE INVENTION

This invention relates generally to door hinges, more specifically, to door hinges that may be adjusted in both the vertical and horizontal directions.

BACKGROUND

Hinges secure door panels to door jambs and provide for quiet opening and closing of pivoting doors. Typical hinges include two leaves, one secured to the door panel, the other secured to the door jamb. The leaves each include mating structures or barrels that extend outward from the leaf secured to the door and the leaf secured to the jamb. These mating structures are shaped to receive a pin, bolt, or other elongate element to join the two leaves together to form a hinged connection. Due to the close tolerances required, these pins are often difficult to install. Also since pins typically include an enlarged head to prevent fall out, they must be installed from the top of the hinge. Notwithstanding this direction of installation, however, over time, the pins may back out of the hinge connection, even when the pins are installed from the top of the hinge.

Additional problems arise with hinges as building walls and floors settle. When first installed, clearances between the door panel and door jamb may be ideal, allowing the door to open and close with ease. As structures settle and shift, however, the clearances between the door panel and door jamb may be reduced, often causing friction. Alternatively or additionally, door panels and frames may contract or expand due to changes in humidity. A door installed during the winter (when humidity is generally lower) may display ideal clearances, but may expand during the humid summer, reducing clearance between the door panel and door jamb. Also, if a door hinge is inadvertently misaligned during installation, problems with operation may ensue. Whether due to settling, humidity, or misalignment, reduced clearance may cause frictional contact between the door panel and door jamb, making the door difficult to open and close.

SUMMARY OF THE INVENTION

In one aspect, the invention relates to an adjustable door hinge having a base, a panel leaf adjustably secured to the base and at least partially defining a vertical adjustment opening, an adjustment transfer element at least partially contained within the vertical adjustment opening, and substantially fixed against rotation relative to the panel leaf, and a vertical adjustment element rotatably connected to the adjustment transfer element, wherein a rotation of the vertical adjustment element adjusts a position of the adjustment transfer element and the panel leaf between a first position and a second position. In an embodiment, the adjustable hinge further includes a plate for adjustably securing the panel leaf to the base. In another embodiment, the panel leaf defines a plurality of slots, the plate has a plurality of posts, and the slots are adapted to slidably receive the posts. In yet another embodiment, the panel leaf at least partially defines a horizontal adjustment opening, and the adjustable hinge further includes a horizontal adjustment element rotatably connected to the horizontal adjustment opening, wherein a rotation of the horizontal adjustment element adjusts a position of an edge portion of the panel leaf between a third position and a fourth position. In still another embodiment, the horizontal adjustment element defines a recess for receiving an adjustment tool.

In another embodiment of the above aspect, the adjustable hinge further includes an adjustment interface rotatably connected to the vertical adjustment element, where the adjustment interface is substantially orthogonal to the vertical adjustment element. In an embodiment, the adjustment interface defines a recess for receiving an adjustment device. In another embodiment, the panel leaf includes a panel barrel. In yet another embodiment, the adjustable hinge further includes a jamb leaf including a jamb barrel, wherein the jamb barrel and the panel barrel are substantially aligned. In still another embodiment, the adjustable hinge further includes a pivot pin of a substantially uniform dimension along at least a portion thereof, wherein the pivot pin is located within the jamb barrel and the panel barrel.

In another embodiment of the above aspect, the adjustable hinge further includes a cap inserted into at least one of the jamb barrel and the panel barrel. In an embodiment, the adjustment transfer element is a nut and the vertical adjustment element is a screw. In another embodiment, the adjustable hinge further includes a plurality of bushings located substantially within the jamb barrel and the panel barrel. In certain embodiments, the bushings each include at least one rib to prevent a rotation within the jamb barrel and the panel barrel. In yet another embodiment, the adjustable hinge further includes a plate fixed to the base, wherein the panel leaf is pivotally mounted to a portion of the plate opposite the edge portion. In still another embodiment, the edge portion of the panel leaf rotates relative to the plate.

The present invention displays advantages over existing adjustable hinges that utilize, for example, a head of a threaded bolt or other elongate component to adjust the vertical position of a door hinge. The present invention reduces friction in the vertical adjustment mechanism by eliminating this head/hinge leaf interface to improve operation. Additionally, existing hinges utilize an adjusting screw located between the hinge barrels and a leaf pivot axis. By locating the leaf pivot axis between the adjustment mechanism and the hinge barrels, as in the present invention, operation is improved. Additionally, the ability to insert the hinge pin from either above or below the door increases versatility of the present invention.

BRIEF DESCRIPTION OF THE FIGURES

Other features and advantages of the present invention, as well as the invention itself, can be more fully understood from the following description of the various embodiments, when read together with the accompanying drawings, in which.

DETAILED DESCRIPTION

Figure 1:
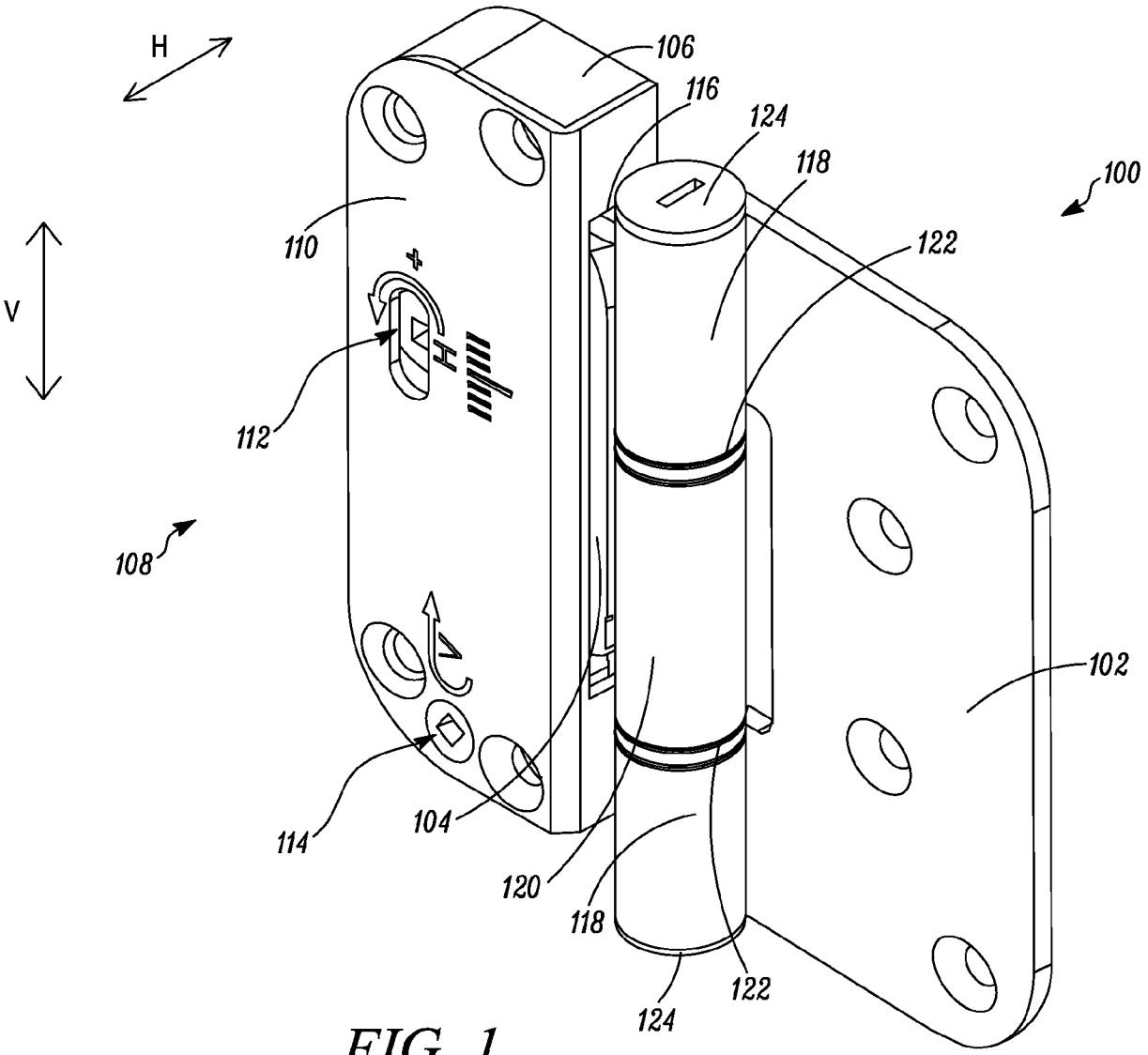
FIG. 1 is a schematic perspective view of an adjustable door hinge in accordance with one embodiment of the present invention.

FIG. 1 depicts a schematic perspective view of an adjustable door hinge 100 in accordance with one embodiment of the invention. The hinge 100 includes a jamb leaf 102 and a panel leaf 104, the former of which is secured directly to a door jamb with screws through a plurality of openings. The panel leaf 104 is received within a receptor base 106 of an adjustable panel portion 108, which is covered by a cover plate 110. Further, the cover plate 110 is secured with screws or other connectors to the receptor base 106 and prevents dirt and other contaminants from entering the receptor base 106 and, along with the receptor base 106, contains the various moving parts of the hinge 100 (as described below). The cover plate 110 also adds a decorative or other finish to the hinge 100. Openings 112 and 114 in the cover plate 110 allow access to a horizontal adjustment mechanism and a vertical adjustment mechanism, which may be actuated by a screwdriver or other instrument. The cover plate 110 may also include adjustment indicators or other symbols to depict adjustment or positional location of the hinge 100. During adjustment (described in more detail below), the vertical and horizontal positions of the panel leaf 104 within the receptor base 106 change. An oversized slot 116 in the cover plate 110 prevents contact between the cover plate 110 and the panel leaf 104, regardless of the position of the panel leaf 104.

One or more barrels are formed on each of the leaves 102 and 104, and are located and aligned to mate with each other. In the depicted embodiment, two jamb barrels 118 are formed on an end of the jamb leaf 102, and a panel barrel 120 is formed on an end of the panel leaf 104. When installed, the two jamb barrels 118 are located above and below the panel barrel 120. When substantially aligned, the barrels 118 and 120 form a channel in which a pivot pin is inserted. Bushings 122 allow for reduced-friction movement between the barrels 118 and 120. Also, caps 124 are located on either end of the barrels 118 to prevent the pivot pin from falling from, or backing out of, the aligned barrels 118 and 120.

Figure 2:
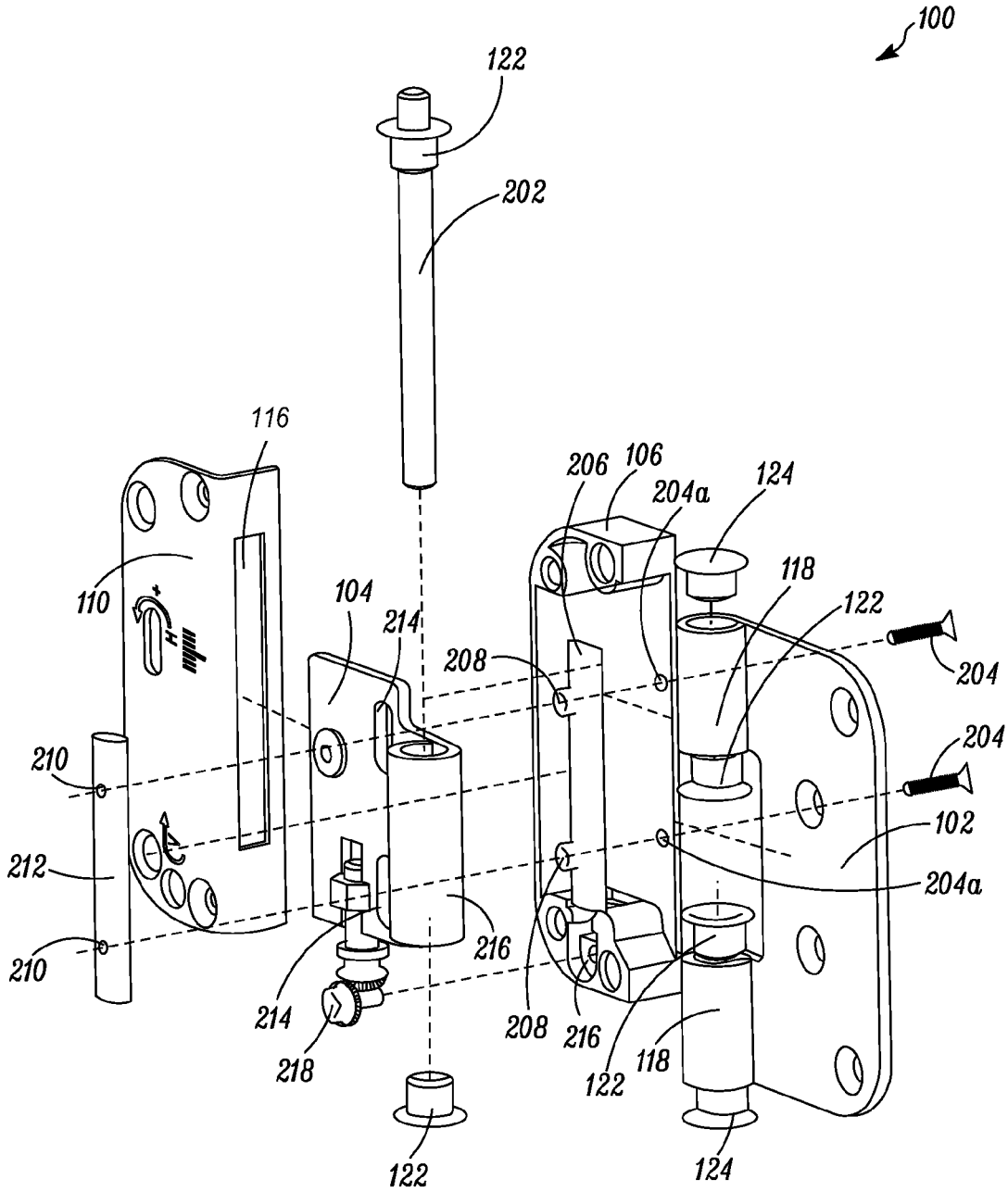
FIG. 2 is an exploded schematic perspective view of the adjustable door hinge of FIG. 1.

FIG. 2 depicts an exploded schematic perspective view of one embodiment of the adjustable door hinge 100 of FIG. 1. Unlike headed pivot pins that have an enlarged head to prevent the pivot pin from falling from the aligned barrels of a hinge, the depicted pivot pin 202 is of a substantially uniform diameter. This allows the pivot pin 202 to be inserted from the top or bottom of the aligned barrels 118 and 120, which is advantageous for hinge installations which have limited clearance above or below the hinge 100. Caps 124 may be screwed on, or press fit, into the top and bottom jamb barrels 118 to secure the pivot pin 202 in place, preventing fall-out or back-out of the pivot pin 202.

Two fixed plate screws 204 pass through a lower fixed plate 206 via the openings 204*a*. The lower fixed plate 206 may define threaded passages for the screws 204 (allowing the screws 204 to secure the lower fixed plate 206 to the receptor base 106) or the passages may be unthreaded. In an alternative embodiment, the lower fixed plate 206 may be otherwise fixed to the receptor base 106 or cast as a single piece integral with the receptor base 106. The screws 204 pass through posts 208 extending from the lower fixed plate 206 and are secured in threaded recesses 210 located in an upper fixed plate 212. The posts 208 extend through slots 214 in the panel leaf 104 and thus allowing the panel leaf 104 to be adjustably secured to the receptor base 106. The dimensions of the posts 208 and the slots 214 allow for vertical adjustment of the panel leaf 104 without interference from the posts 208. Additionally, the posts 208 prevent the panel leaf 104 from being pulled out from the receptor base 106. The receptor base 106 also defines a recess 216 for receiving a bevel gear 218, which is used to adjust the vertical position of the hinge 100, as described below. A slot 116 is oversized to allow vertical movement of the panel leaf 104 within the receptor base 106.

Figure 3:
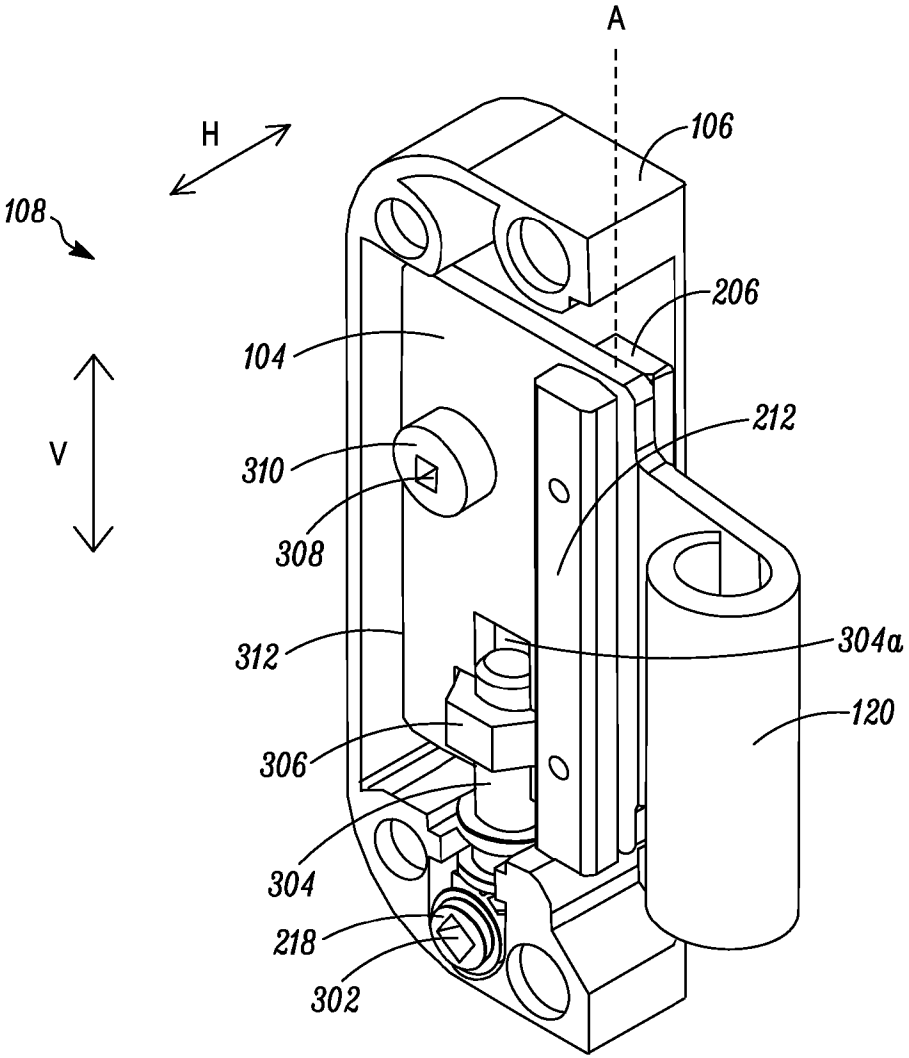
FIG. 3 is a schematic perspective view of an adjustable panel portion of the adjustable door hinge of FIG. 1 with a cover plate removed.

FIG. 3 depicts a schematic perspective view of the adjustable panel portion 108 of the adjustable door hinge 100 of FIG. 1 with the cover plate 110 removed. To adjust the vertical position of the panel leaf 104 within the receptor base 106, a user may insert a screwdriver, hex key wrench, or other adjustment tool into a recess 302, located within the bevel gear 218, to rotate the bevel gear 218. The bevel gear 218 acts as an adjustment interface, allowing rotation of a vertical adjustment element 304, even though the axis of rotation of the bevel gear 218 is located substantially orthogonal to the vertical adjustment element 304. In an alternative embodiment, the bevel gear 218 may be eliminated and the vertical adjustment element 304 may be accessed from the bottom of the receptor base 106 and adjusted directly with an adjustment tool. As the vertical adjustment element 304 rotates, an adjustment transfer element 306 transfers the rotational movement of the vertical adjustment element 304 into vertical movement of the panel leaf 104.

The slots 214 of the panel leaf 104 slide along the posts 208 during adjustment. The panel leaf 104 at least partially defines a vertical adjustment opening 304*a* that receives the vertical adjustment element 304 and the adjustment transfer element 306, and thus allows for the panel leaf 104 to be adjusted substantially along the vertical axis V as the adjustment transfer element 306 moves. In the depicted embodiment, the vertical adjustment element 304 and the adjustment transfer element 306 are a threaded screw and a nut respectively. However, it is contemplated that the vertical adjustment element 304 and the adjustment transfer element 306 may be of any configuration that can transfer a rotation of the vertical adjustment element 304 to a linear movement of the panel leaf 104 substantially along the vertical axis V.

To adjust the horizontal position of the panel leaf 104 within the receptor base 106, a user may insert a similar or differently configured adjustment tool into a recess 308 located within a horizontal adjustment element 310 to rotate the horizontal adjustment element 310. In the depicted embodiment, the panel leaf 104 at least partially defines a horizontal adjustment opening to receive the horizontal adjustment element 310. In the depicted embodiment, the horizontal adjustment element 310 is a threaded screw and the horizontal adjustment opening is threaded. As the horizontal adjustment element 310 is rotated, the position of the panel leaf 104 along the depth of the screw changes, so as to adjust the horizontal position of the panel barrel 120 by changing the angle of the panel leaf 104 relative to the receptor base 106. The lower fixed plate 206 and the upper fixed plate 212 act as a pivot axis A about which the panel leaf 104 may be rotated. In general, an edge portion 312 of the panel leaf 104 moves within the receptor base 106, while a portion of the panel leaf 104 proximate the pivot axis and opposite to the edge portion 312 remains relatively fixed. The extent of this rotational movement of the edge portion 312 of the panel leaf 104 is limited at least in part by the total depth of the receptor base 106 and the length of the horizontal adjustment element 310. To facilitate this rotation, the surfaces of both the lower fixed plate 206 and the upper fixed plate 212 that interface with the panel leaf 104 are curved, as shown in more detail in subsequent figures.

Figure 4:
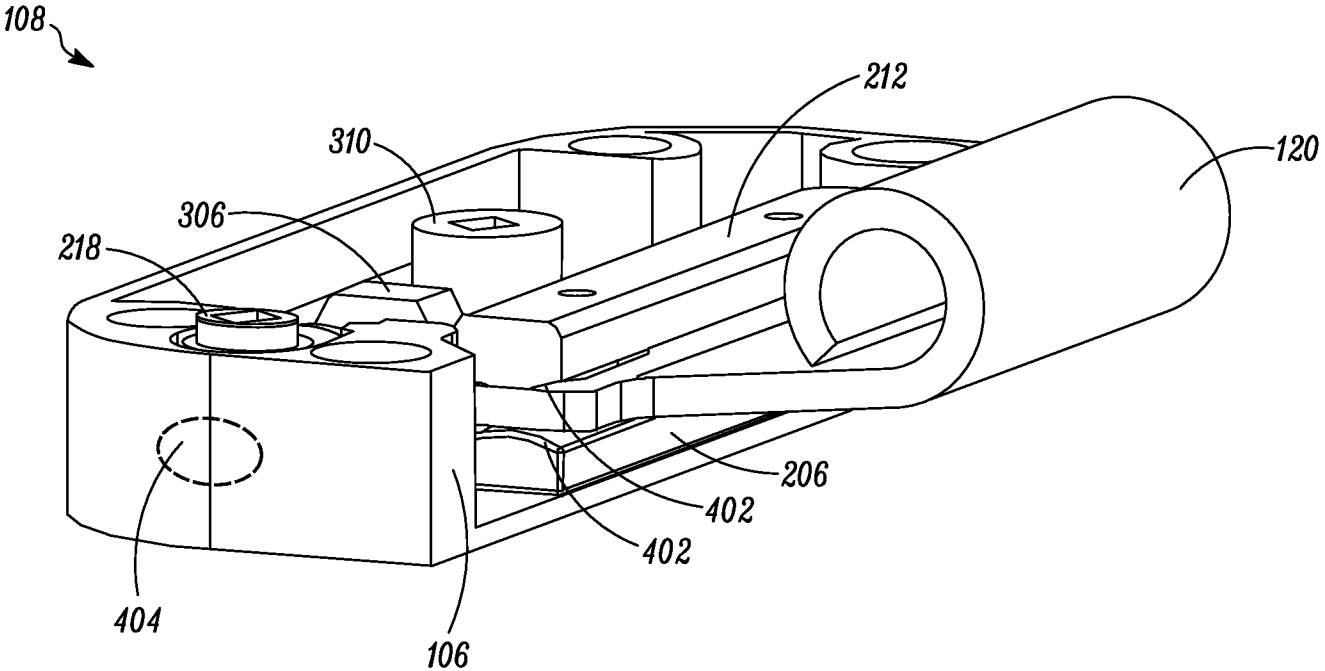
FIG. 4 is another schematic perspective view of the adjustable panel portion of the adjustable door hinge of FIG. 1 with the cover plate removed.

FIG. 4 is another schematic perspective view of the adjustable panel portion 108 of the adjustable door hinge 100 of FIG. 1, with the cover plate 110 removed. In this figure, curved surfaces 402 of the lower fixed plate 206 and the upper fixed plate 212 are more clearly depicted. Additionally, an alternative location 404 for the vertical adjustment mechanism (on the bottom of the receptor base 106) is identified. Having both of the vertical adjustment mechanism and the horizontal adjustment mechanism accessible from the face of the cover plate 110 may be desirable, however, since the cover plate 110 is easily accessible regardless of the orientation of the hinge 100 on a door panel.

Figure 5:
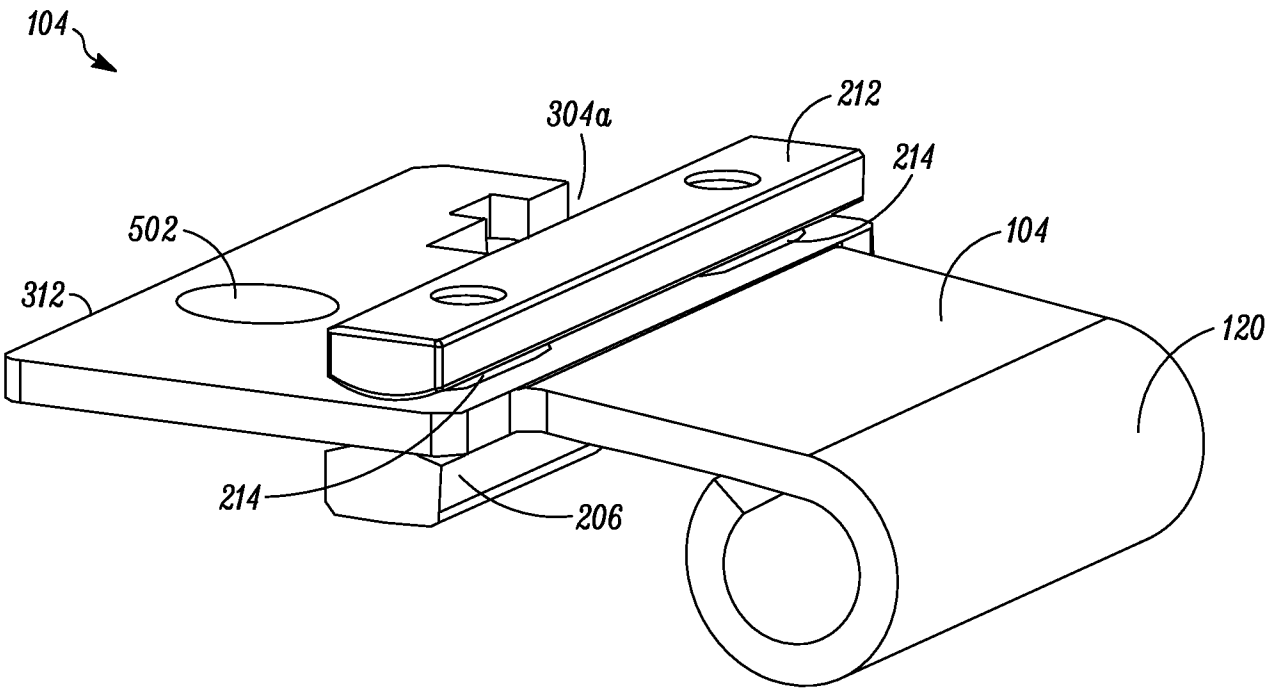
FIG. 5 is a schematic perspective view of a panel leaf, an upper fixed plate, and a lower fixed plate of the adjustable door hinge of FIG. 1.
Figure 6:
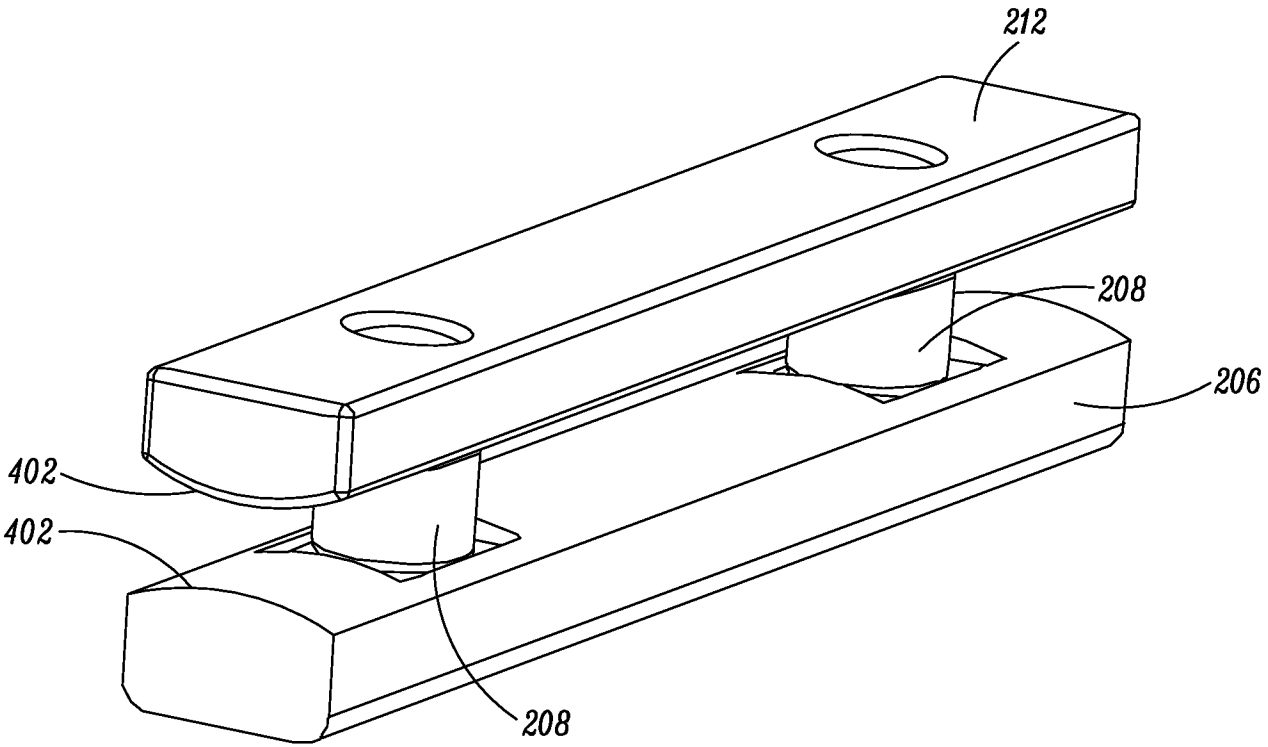
FIG. 6 is a schematic perspective view of the upper fixed plate and the lower fixed plate of FIG. 5.

FIG. 5 depicts a schematic perspective view of the panel leaf 104, the lower fixed plate 206 and the upper fixed plate 212 of the adjustable door hinge 100 of FIG. 1. In this figure, the horizontal adjustment opening 502 and the vertical adjustment opening 304*a* in the panel leaf 104 are depicted. FIG. 6 depicts a schematic perspective view of the lower fixed plate 206 and the upper fixed plate 212 of FIG. 5. The posts 208 are sized to extend through the slots 214 defined by the panel leaf 104 to allow for movement substantially along the vertical axis V. Additionally, as noted above, the curved surfaces 402 of the lower fixed plate 206 and the upper fixed plate 212 allow for horizontal adjustment of the panel leaf 104, as described above.

Figure 7:
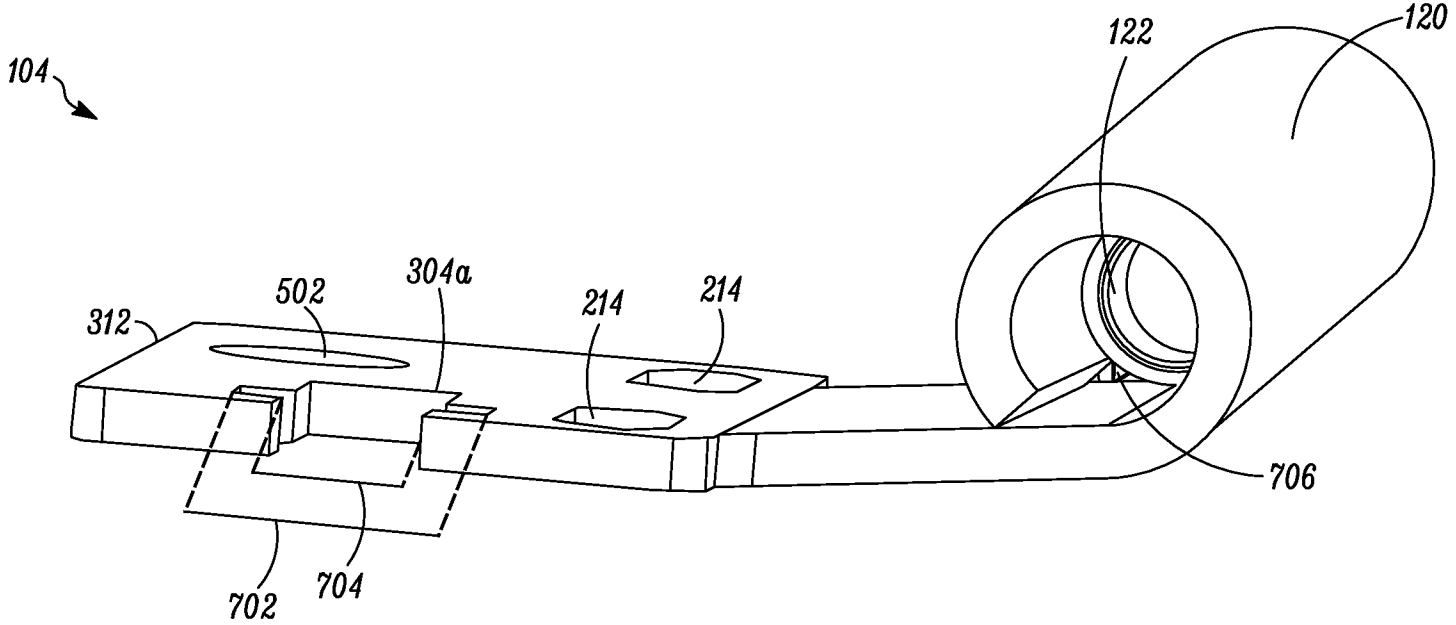
FIG. 7 is a schematic perspective view of the panel leaf of FIG. 5.

FIG. 7 is a schematic perspective view of the panel leaf 104 of FIG. 5. As depicted in this figure, the panel leaf 104 defines a plurality of slots 214 for receipt of the posts 208 described above, as well as the horizontal adjustment opening 502 and the vertical adjustment opening 304*a*. The vertical adjustment opening 304*a* is sized to receive both the adjustment transfer element 306 and the vertical adjustment element 304 in a first opening portion 702 and a second opening portion 704 respectively, as depicted in the figure. The staggered profile of the first opening 702 allows the adjustment transfer element 306 to transfer both upward and downward vertical movement to the panel leaf 104. FIG. 7 also depicts one of the bushings 122 inserted into the panel barrel 120. The bushings 122 are designed with a rib 706 that is trapped between a curl of the barrels 118 or 120 and a face of the leaves 102 or 104. The rib 706 prevents the bushings 122 from spinning inside the barrels 118 and 120, and ensures that the bushings 122 located on the mating jamb barrel 118 and panel barrel 120 are sliding against each other instead of rotating against the barrels 118 and 120. The rib 706 need not be used, but it helps prevent the bushings 122 from spinning and wearing prematurely, if the bushings 122 were to rub against the barrels 118 and 120 which may be metallic.

The materials utilized in the manufacture of the hinge 100 may be those typically utilized for hinge manufacture, e.g., zinc, steel, brass, stainless steel, etc. Material selection for most of the components may be based on the proposed use of the hinge 100. Appropriate materials may be selected for hinges used on particularly heavy door panels, as well as on hinges subject to certain environmental conditions (e.g., moisture, corrosive atmospheres, etc.). For particularly lightweight door panels (for example, cabinet door panels), molded plastic, such as PVC, polyethylene, etc., may be utilized for the receptor base, cover plate, leaves and other components. Nylon, acetal, Teflon®, or combinations thereof may be utilized for the bushings 122 to reduce friction, although other low-friction materials are contemplated. Threaded or press fit metal or nylon caps also may be used.

The terms upper, lower, top, bottom, panel, jamb, etc., as used herein, are relative terms used for convenience of the reader and to differentiate various elements of the adjustable hinge 100 from each other. In general, unless otherwise noted, the terms are not meant to define or otherwise restrict location of any particular element. For example, the adjustable hinge 100, as disclosed therein, may be installed on a door panel with the vertical adjustment mechanism located near the top or bottom of the hinge 100, depending on the orientation of the hinge 100 during installation. Additionally, the jamb leaf 102 may be secured to the door panel and the receptor base 106 may be secured to the door jamb. Alternatively, the hinge 100 could be used with the barrels 118 and 120, and pivot pin 202 oriented in a horizontal manner. Additionally, the jamb leaf may form a single jamb barrel, while the panel leaf may form two jamb barrels. Either leaf may also form multiple barrels, as desired for a particular application.

While there have been described herein what are to be considered exemplary and preferred embodiments of the present invention, other modifications of the invention will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the invention. Accordingly, what is desired to be secured by Letters Patent is the invention as defined and differentiated in the following claims, and all equivalents.

What is claimed is:

1. An adjustable door hinge comprising:

a base;

a panel leaf adjustably secured to the base and at least partially defining a vertical adjustment opening;

a pair of plates, at least one of which is fixed to the base, wherein the panel leaf is pivotally mounted between curved opposing surfaces of the plates;

at least one post extending between the plates, the at least one post extending through at least one opening in the panel leaf;

an adjustment transfer element at least partially contained within the vertical adjustment opening, and substantially fixed against rotation relative to the panel leaf;

and a vertical adjustment element rotatably connected to the adjustment transfer element, wherein a rotation of the vertical adjustment element adjusts a position of the adjustment transfer element and the panel leaf between a first position and a second position.

2. The adjustable hinge of claim 1, wherein the plates are adapted to adjustably secure the panel leaf to the base.

3. The adjustable hinge of claim 1, wherein the at least one opening in the panel leaf is at least one slot adapted to slidably receive the at least one post.

4. The adjustable hinge of claim 1, wherein the panel leaf at least partially defines a horizontal adjustment opening, and wherein the adjustable hinge further comprises a horizontal adjustment element rotatably connected to the horizontal adjustment opening, wherein a rotation of the horizontal adjustment element adjusts a position of an edge portion of the panel leaf between a third position and a fourth position.

5. The adjustable hinge of claim 4, wherein the horizontal adjustment element defines a recess for receiving an adjustment tool.

6. The adjustable hinge of claim 1, further comprising an adjustment interface rotatably connected to the vertical adjustment element, wherein the adjustment interface is substantially orthogonal to the vertical adjustment element.

7. The adjustable hinge of claim 6, wherein the adjustment interface defines a recess for receiving an adjustment device.

8. The adjustable hinge of claim 1, wherein the panel leaf comprises a panel barrel.

9. The adjustable hinge of claim 8, further comprising a jamb leaf comprising a jamb barrel, wherein the jamb barrel and the panel barrel are substantially aligned.

10. The adjustable hinge of claim 9, further comprising a pivot pin of a substantially uniform dimension along at least a portion thereof, wherein the pivot pin is located within the jamb barrel and the panel barrel.

11. The adjustable hinge of claim 10, further comprising a cap inserted into at least one of the jamb barrel and the panel barrel.

12. The adjustable hinge of claim 1, wherein the adjustment transfer element comprises a nut and the vertical adjustment element comprises a screw.

13. The adjustable hinge of claim 9, further comprising a plurality of bushings located substantially within the jamb barrel and the panel barrel.

14. The adjustable hinge of claim 13, wherein the bushings each comprise at least one rib to prevent a rotation within the jamb barrel and the panel barrel.

15. The adjustable hinge of claim 1, wherein the panel leaf is pivotally mounted to portions of the plates opposite an edge portion of the panel leaf.

16. The adjustable hinge of claim 15, wherein the edge portion of the panel leaf is adapted to rotaterelative to the plates.

* * * * *

UNITED STATES PATENT AND TRADEMARK OFFICE

CERTIFICATE OF CORRECTION

PATENT NO. : 8,429,794 B2
APPLICATION NO. : 12/730468
DATED : April 30, 2013
INVENTOR(S) : Tagtow et al.

It is certified that error appears in the above-identified patent and that said Letters Patent is hereby corrected as shown below:

In the Claims:

In claim 16, column 8, line 15, replace “rotaterelative” with -- rotate relative --.

Signed and Sealed this
Twenty-fifth Day of June, 2013

Teresa Stanek Rea
*Acting Director of the United States Patent and Trademark Office*